US005116661A

United States Patent [19]

Matsubara

[11] Patent Number: 5,116,661

[45] Date of Patent: May 26, 1992

[54] DRIP-ABSORBING SHEET

[75] Inventor: Mamoru Matsubara, Tokyo, Japan

[73] Assignee: Showa Denko K.K., Tokyo, Japan

[21] Appl. No.: 604,317

[22] Filed: Oct. 29, 1990

[30] Foreign Application Priority Data

Jul. 10, 1990 [JP] Japan ..... 2-182086

[51] Int. Cl.[5] ..... B32B 27/14

[52] U.S. Cl. ..... 428/198; 428/327; 428/341; 428/532

[58] Field of Search ..... 428/198, 323, 411.1, 428/193, 327, 341, 532

[56] References Cited

U.S. PATENT DOCUMENTS 4,383,376 5/1983 Numamoto et al. ..... 34/9
4,686,776 8/1987 Matsubara ..... 426/124
4,819,342 4/1989 Matsubara et al. ..... 34/95

FOREIGN PATENT DOCUMENTS 58-43922 10/1983 Japan .
58-58124 12/1983 Japan .
61-3337 2/1986 Japan .
1-22816 4/1989 Japan .

*Primary Examiner*—Bruce H. Hess
*Assistant Examiner*—William Krynski
*Attorney, Agent, or Firm*—Sughrue, Mion, Zinn, Macpeak & Seas

[57] ABSTRACT

A drip-absorbing sheet comprising a powdery or granular edible saccharide supported and laminated between a semipermeable membrane and a water-absorbing porous sheet. This drip-absorbing sheet has a simple structure and can be automatically manufactured without the need for a large labor force, thus reducing the manufacturing cost. This sheet can be cut to an optional size according to an intended use, and the incorporated saccharide will not drop from the cut portion.

4 Claims, 1 Drawing Sheet

DRIP-ABSORBING SHEET

BACKGROUND OF THE INVENTION (1) Field of the Invention

The present invention relates to a low-cost drip-absorbing sheet for absorbing and separating drips generated from perishable foods, to prevent a lowering of the quality of the foods.

(2) Description of the Related Art

In perishable foods such as meat, fish, vegetables and fruits (hereinafter referred to as "foods"), when the cells thereof are destroyed, fluids inside and outside the cells flow out, resulting in a loss of freshness of the foods.

This loss of freshness causes a lowering of the water retention of foods and an increased quantity of an exudate, i.e., "drip", whereupon an autolysis of the foods, a propagation of bacteria, an oxidation of lipids, and a discoloration of the foods occur, and the lowering of the quality thereof is accelerated.

It is well-known in the food industry that, if the drips thus generated can be separated, this will effectively maintain the freshness of foods. Nevertheless if foods are stored in the state where drips generated from foods are absorbed in paper, sponge or the like, although it seems that the drips are separated from the foods, the foods are always in contact with the drips and the effect of maintaining the freshness thereof cannot be obtained.

On the other hand, if a part of water contained in foods is separated in advance, and the foods are stored in this state, the generation of drips is controlled and the freshness effectively maintained.

Also the method of storing foods while absorbing and separating drips exuding from the foods is effective.

As the food-preserving method, there has been long adopted a method in which foods are placed in direct contact with a water-absorbing substance, to remove water from the foods and improve the preservability thereof, but this method is defective in that the taste of the foods is changed.

With the development of water-absorbing polymers, as the means for reducing the water content in foods or removing generated drips without changing the taste of the foods, there have recently been proposed various water-removing sheets comprising a combination of a water-absorbing polymer and a semipermeable membrane (see, for example, Japanese Examined Utility Model Publication No. 58-43922, Japanese Examined Patent Publication No. 58-58124, Japanese Examined Utility Model Publication No. 61-3337, Japanese Examined Patent Publication No. 1-22816 and U.S. Pat. No. 4,383,376), and water-removing sheets comprising a semipermeable membrane and a liquid saccharide (see U.S. Pat. No. 4,819,342). These sheets are utilized for removing water from foods in advance, before storage, or for separating drips generated from foods during storage.

In these water-removing sheets, a granular polymeric water absorber or a liquid saccharide is used and enveloped so that one surface of the envelope is formed of a semipermeable membrane, and the periphery of the semipermeable membrane is bonded to effect a sealing thereof. Accordingly, the water-absorbing sheet of this type is advantageous in that the sheet can be used repeatedly, but a special technique or apparatus is necessary for the production and the number of steps is high and therefore, the manufacturing cost is increased.

Furthermore, since the sheet is marketed in the state where the periphery is bonded and sealed, variations of the sizes are limited and a user must select an appropriate size: often it is impossible to obtain a sheet having a desirable size.

SUMMARY OF THE INVENTION

The inventors carried out research with a view to solving the foregoing problems, and considered that, if a drip-absorbing sheet is prepared by using a material that will not give problems concerning food sanitation, without bonding and sealing the periphery of a semipermeable membrane, a sheet having a desirable size can be optionally obtained by cutting, the number of manufacturing steps can be reduced, and a product having a low price can be provided.

The present invention has been completed based on the above consideration, and a primary object of the present invention is to provide a low-cost throwaway drip-absorbing sheet that can be used after being cut to a required size.

In accordance with the present invention, this object can be attained by a drip-absorbing sheet comprising a powdery or granular edible saccharide supported and laminated between a water-permeable semipermeable membrane and a water-absorbing porous sheet.

In the present invention, preferably the amount of the powdery or granular edible saccharide is from 10 to 200 $g/m^2$, and the weight of the water-absorbing porous sheet is 0.2 to 10 times the weight of the edible saccharide.

In view of the handling ease, preferably the sheet is partially bonded through an adhesive, as long as the water permeability is not adversely affected.

Moreover, in the present invention, the semipermeable membrane and the water-absorbing porous sheet can be bonded by using an edible saccharide having a melting point lower than the melting temperature or carbonization temperature of the semipermeable membrane or water-absorbing porous sheet, and heat-pressing the laminate.

Since the drip-absorbing sheet of the present invention has the above-mentioned structure, even if the sheet is used after cutting to a required size, no problems arise concerning food sanitation, and drips removed through the semipermeable membrane can be separated from foods. Moreover, the structure is simple and the sheet can be automatically manufactured by an apparatus without the need for a large labor force.

DESCRIPTION OF THE PREFERRED EMBODIMENTS

Figure 1:
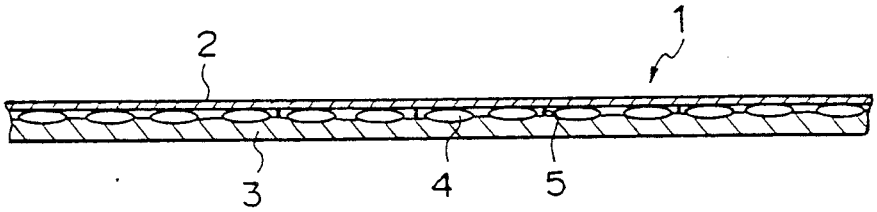
FIG. 1 is a longitudinally sectional view illustrating one embodiment of the drip-absorbing sheet of the present invention; and, FIG. 2 is a diagram illustrating an example of the state of use of the sheet shown in FIG. 2.

FIG. 1 shows an embodiment of the drip-absorbing sheet (hereinafter referred to as "absorbing sheet") 1 according to the present invention. In FIG. 1, reference numeral 2 represents a water-permeable semipermeable membrane which is arranged as the front surface material, and a water-absorbing porous sheet 3 (hereinafter referred to as "porous sheet") is arranged as the back surface material. A powdery or granular saccharide 4 is supported between the semipermeable membrane 2 and porous sheet 3. If the semipermeable sheet 2 and porous sheet 3 are bonded at points appropriately spaced from one another by using an adhesive 5 within a range not affecting the water permeability, a mutual divergence does not occur between the semipermeable membrane 2 and porous sheet 3, and the sheet can be handled very easily.

Figure 2:
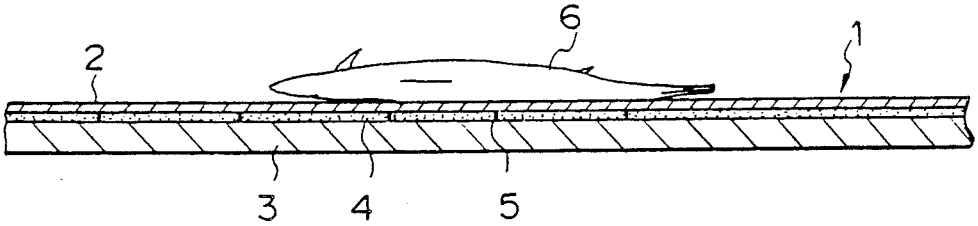

When a perishable food 6 is placed on the semipermeable membrane 2 of the absorbing sheet 1 having the structure as shown in FIG. 2, a part of water contained in the food permeates through the semipermeable membrane 2 while swelling the permeable membrane 2. The saccharide 4 is dissolved by this permeating water to form an aqueous solution and generate a strong osmotic pressure, with the result that a water-absorbing function is exerted. This water-absorbing force is maintained until the difference of the osmotic pressure between the food 6 and the aqueous solution of the saccharide disappears. The aqueous solution of the saccharide formed by this absorption of water is absorbed and retained in the porous sheet 3, and accordingly, the drip is completely separated from the food by the semipermeable membrane 2 and the freshness of the food is maintained.

Each of the semipermeable membrane 2, porous sheet 3, and saccharide 4 used for the absorbing sheet 1 of the present invention must be composed of a material which is safe even when in direct contact with food.

As the semipermeable membrane 2, there can be mentioned, for example, a usual cellophane sheet and a completely saponified polyvinyl alcohol sheet.

As the saccharide, there can be used low-molecular-weight solid saccharides such as fructose, glucose, oligosaccharide, maltose, powder corn syrup and sucrose. These saccharides have a low permeability through a semipermeable membrane and have a high osmotic pressure, and thus show a strong water-absorbing property.

Further, these saccharides can be used in the form of mixtures of two or more thereof. Furthermore, these saccharides can be mixed with other water-soluble polymeric compound such as sodium slginate, carboxymethyl cellulose or starch, whereby the viscosity of the aqueous solution of the saccharide is increased the force of retaining the aqueous solution of the saccharide in the porous sheet 3 can be increased and the water-absorbing capacity can be increased.

As the porous sheet, there can be mentioned, for example, a paper sheet, a fabric, a nonwoven fabric and a foamed sponge, but any materials that can absorb water therein and are safe even when in contact with foods, in the form of a sheet, can be used without particular limitation.

A starch type adhesive is most preferably used as the adhesive from the viewpoint of food sanitation, but other materials that can be used as a food-packaging material can be used in the present invention.

The materials admitted as materials for foods, such as foods per se, food additives and food-packaging materials, must be used as the constituent materials of the absorbing sheet of the present invention.

The absorbing sheet of the present invention is prepared by uniformly scattering the powdery or granular edible saccharide on the porous sheet 3, piling the semipermeable member having an adhesive coated on the surface thereof in the form of dots having a diameter of 100 to 500 $\mu$m at a density of 10 to 100 dots per $cm^2$, and pressing the assembly to partially bond and integrate the porous sheet 3 and the semipermeable membrane. The amount of the saccharide scattered on the porous sheet 3 per $m^2$ of the sheet is small, and thus the bonding is not hindered by the saccharide.

The above operation is carried out continuously by using an appropriate apparatus, and the formed sheet is wound in the form of a roll or is cut to prepare a long absorbing sheet 1.

The sheet is used after it is cut to a required size according to the intended use. At this step, the powdery or granular saccharide could drop from the cut portion, but by sucking the cut portion, this can be prevented to an extent such that no practical problem arises.

If a saccharide having a melting point lower than the melting temperature or carbonization temperature of the semipermeable membrane or water-absorbing porous sheet is used as the edible saccharide, and the assembly is heat-pressed from both the surfaces at a temperature lower than the melting temperature or carbonization temperature to melt the saccharide, the semipermeable membrane and water-absorbing porous sheet are bonded through the saccharide and a drip-absorbing sheet is formed.

In this absorbing sheet, selection of the semipermeable membrane, water-absorbing porous sheet and edible saccharide to be combined is limited, but even if the absorbing sheet is freely cut, a dropping of the saccharide from the cut portion does not occur and the absorbing sheet can be easily prepared.

The amount scattered of the saccharide is determined according to the amount of drips generated from the food to be dehydrated. In the case of fish and meat, the amount of drips is about 3% based on the weight of the food, and the saccharide is preferably scattered in an amount of about 20 g/$m^2$. In the case of a frozen food, the amount of drips is large, in an extreme case the amount of drips is as large as 20% based on the weight of the food. Accordingly, in this case, the saccharide must be scattered in an amount of about 150 g/$m^2$.

If the amount scattered of the saccharide is too small, a dehydrating effect cannot be attained, and if the amount scattered of the saccharide is too large, bonding between the semipermeable membrane and the porous sheet becomes difficult, i.e., the effect is not improved over a certain level and the sheet becomes disadvantageous in view of the cost. Therefore, the amount scattered of the saccharide is appropriately selected within the range of from 10 to 200 g/$m^2$, according to the kind of the food to be dehydrated.

The base weight of the porous sheet per unit area is preferably adjusted to 20 to 200 g/$m^2$, in view of the retention amount of the saccharide and the water absorption quantity. When the amount of drips generated from the objective food is large, the base weight of the porous sheet must be increased, but since the above-mentioned porous sheet can absorb and retain the aqueous solution of the saccharide in an amount (weight) about 20 times the weight of the porous sheet under atmospheric pressure, preferably a porous sheet having a base weight about 0.2 to 10 times the weight of the saccharide is used.

The present invention will now be described in detail with reference to the following examples, that by no means limit the scope of the invention.

EXAMPLE 1

Various foods were brought into contact with a conventional water-removing sheet having a large water-absorbing capacity (Pichit ® Sheet supplied by Showa Denko), placed in a refrigerator at 3° to 5° C., and the flow-out rates of the drips were measured.

The results are shown in Table 1.

TABLE 1

| Run No. | Food: Kind | Food: Amount Used | Contact Bottom Area ($dm^2$) | Contact Time (hr) | Amount Generated of Drips (g) | Drip Flow-Out Rate ($g/dm^2 \cdot hr$) |
|---|---|---|---|---|---|---|
| 1 | Slice of cod | 80 g/slice × 20 | 11.25 | 8 | 80 | 0.89 |
| 2 | thawed cleft tuna | 200 g | 1.6 | 5 | 12 | 1.5 |
| 3 | tuna (raw) | 200 g | 1.6 | 12 | 5 | 0.26 |
| 4 | red fish pickled in sake lees | 300 g/slice × 2 | 2.7 | 8 | 24 | 1.11 |
| 5 | raw chicken ham meat without skin | 250 g | 1.5 | 8 | 15 | 1.25 |
| 6 | cut fruit | 150 g | 0.64 | 4 | 6.0 | 2.3 |

From the results shown in Table 1, the drip flow-out rates of the foods are in the range of from 0.2 to 3.0 $g/dm^2.hr$, and water-removing sheets must have a water-absorbing capacity exceeding such drip flow-out rates.

EXAMPLE 2

Drip-absorbing sheets were prepared by using natural material as mentioned below.

A cellophane paper (PT300 supplied by Tokyo Cellophane) was used as the semipermeable membrane.

Anhydrous crystalline fructose (AHC Arc supplied as Sanmatsu Kogyo) and refined white sugar (supplied by Mitsui Seito) were used as the saccharide.

A paper towel (supplied by Daio Seishi) was used as the water-absorbing porous sheet.

A starch paste was used as the adhesive.

Sheets were prepared by scattering various amounts of the saccharide on paper towels differing in thickness, piling the cellophane paper having the starch paste coated in the form of dots on the surface thereof, and press-bonding the assemblies. The amount used of the saccharide and the base weight of the paper towel are shown in Table 2.

TABLE 2

| Sheet No. | Fructose ($g/m^2$) | Amount Used of Refined White Sugar ($g/m^2$) | Base Weight of Paper Towel ($g/m^2$) |
|---|---|---|---|
| 1 | 200 | — | 120 |
| 2 | 100 | — | 80 |
| 3 | 20 | — | 40 |
| 4 | 10 | — | 80 |
| 5 | — | 150 | 80 |
| 6 | — | 50 | 40 |
| 7 | cellophane was dot-bonded to paper towel without using saccharide | | 40 |

The above sheets were brought into contact with bean curd (having a thickness of 2.2 cm and a contact area of 0.9 $dm^2$), opened and dried horse mackerel (having a contact area of 1 $dm^2$), and sliced radish (having a thickness of 1.7 cm and a contact area of 1 $dm^2$) at room temperature (20° C.) for 3 hours, and the drip-absorbing rates were determined. The results are shown in Table 3.

TABLE 3

| Sheet No. | Food: Bean Curd ($g/dm^2 \cdot hr$) | Food: Opened and Dried Horse Mackerel ($g/dm^2 \cdot hr$) | Food: Sliced Radish ($g/dm^2 \cdot hr$) |
|---|---|---|---|
| 1 | 5.9 | 1.8 | 2.8 |
| 2 | 5.7 | 1.7 | 2.8 |
| 3 | 5.6 | 1.2 | 0.8 |
| 4 | 4.3 | 0.3 | 0.4 |
| 5 | 5.5 | 1.8 | 2.6 |
| 6 | 5.5 | 1.3 | 0.7 |
| 7 | 1.8 | 0.1 | 0.2 |

EXAMPLE 3

Drip-absorbing sheets were prepared by using the synthetic materials described below.

A polyvinyl alcohol film (LH-18 supplied by Tokyo Cellophane) was used as the semipermeable membrane, powdery malt (SLD-25 supplied by Sanmatsu Kogyo) was used as the saccharide, foamed urethane sponge was used as the water-absorbing sheet, and a commercially available adhesive (Takelac A-712-B/Takenate A-72B supplied by Takeda Yakuhin Kogyo) was used as the adhesive.

Drip-absorbing sheets were prepared in the same manner as described in Example 2, by using the foregoing materials. The amount of the powdery malt and the base weight of the foamed urethane sponge are shown in Table 4.

TABLE 4

| Sheet No. | Powdery Malt ($g/m^2$) | Base Weight of Foamed Urethane Sponge ($g/m^2$) |
|---|---|---|
| 8 | 40 | 40 |
| 9 | 80 | 40 |
| 10 | 120 | 40 |
| 11 | polyvinyl alcohol sheet was dot-bonded to foamed urethane sponge without using powdery malt | 40 |

The foregoing sheets were placed in contact with devil's-tongue paste (having a thickness of 3.7 cm and a contact area of 1.2 $dm^2$) and raw tuna (having a thickness of 1.4 cm and a contact area of 1.6 $dm^2$) in a refrigerator at 2° C. for 8 hours, and the drip -absorbing rates were measured. The results are showing Table 5.

TABLE 5

| Sheet No. | Food: Devil's-tongue Paste ($g/dm^2 \cdot hr$) | Food: Raw Tuna ($g/dm^2 \cdot hr$) |
|---|---|---|
| 8 | 1.13 | 0.40 |
| 9 | 1.86 | 0.63 |
| 10 | 2.08 | 0.81 |

TABLE 5-continued

| Sheet No. | Food: Devil's-tongue Paste ($g/dm^2 \cdot hr$) | Food: Raw Tuna ($g/dm^2 \cdot hr$) |
|---|---|---|
| 11 | 0.23 | 0.12 |

EXAMPLE 4

Anhydrous crystalline fructose (supplied by Sanmatsu Kogyo and having a melting point of 146° C.) was scattered in an amount of 100 $g/m^2$ and supported between a cellophane paper (RT-300 supplied by Tokyo Cellophane) and a paper towel (supplied by Daio Seishi). The assembly was heat-pressed at a temperature of 160° C. under a pressure of 30 $kg/cm^2$ for 20 seconds, by using a hot press to melt the fructose and bond the cellophane tape to the paper towel, whereby a paper-absorbing sheet was prepared. When this sheet was cut, dropping of the saccharide from the cut portion did not occur. The water-absorbing capacity of this water-absorbing sheet was equivalent to that of water-absorbing sheet No. 2 of Example 2.

The following can be seen from the results obtained in Examples 1 through 4.

(a) If a saccharide is not present, the water-absorbing property is low and the sheet cannot be practically used.

(b) Even if the amount of the saccharide exceeds 200 $g/m^2$, no further improvement of the performance is attained and the use of such a large amount of the saccharide has no significance.

(c) The water-absorbing capacity of fructose is higher than that of sucrose, and as the molecular weight is low, the water-absorbing capacity is high.

(d) The aqueous solution of the saccharide formed by an absorption of water can be sufficiently retained if the water-absorbing porous sheet is used in an amount (weight) 0.2 to 10 times the weight of the saccharide.

(e) A variety of drip-absorbing sheets having high performances can be prepared by using the combination of semipermeable membrane/saccharide/-water-absorbing porous sheet.

(f) By selecting the combination of semipermeable membrane/saccharide/water-absorbing sheet, a drip-absorbing sheet can be easily prepared while using the saccharide as the adhesive.

As apparent from the foregoing description, the drip-absorbing sheet of the present invention has a simple structure and can be automatically prepared by using an appropriate apparatus without the need for a large labor force. Moreover, the water-absorbing sheet of the present invention can be prepared by using materials admitted to be safe from the sanitary viewpoint, especially natural materials alone, the manufacturing cost can be reduced, and the reliability is high.

Moreover, since the water-absorbing sheet can be cut to a size suitable for an intended use, no waste occurs. If appropriate materials are selected, when the used drip-absorbing sheet is discarded and burnt, a harmful gas is not generated, and when the drip-absorbing sheet is buried under the ground, the sheet is easily biologically decomposed and there is no risk of environmental pollution. Accordingly, the drip-absorbing sheet of the present invention is advantageous from various viewpoints.

I claim:

1. A drip-absorbing sheet comprising a powdery or granular edible saccharide supported and laminated between a semipermeable membrane and a water-absorbing porous sheet, wherein the amount of the powdery or granular edible saccharide is 10 to 200 $g/m^2$.

2. A drip-absorbing sheet as set forth in claim 1 wherein the weight of the water-absorbing porous sheet is 0.2 to 10 times the weight of the edible saccharide.

3. A drip-absorbing sheet as set forth in claims 1 or 2, wherein the semipermeable membrane and the water-absorbing porous sheet are partially bonded through an adhesive within a range not adversely affecting the water permeability

4. A drip-absorbing sheet as set forth in claims 1 or 2, wherein an edible saccharide having a melting point lower than the melting temperature or carbonization temperature of the semipermeable membrane or water-absorbing porous sheet is used as the saccharide, and the assembly is heat-pressed at a temperature lower than said melting temperature or carbonization temperature to melt the saccharide and bond the semipermeable membrane and the water-absorbing porous sheet.

* * * * *